US007910529B2

(12) United States Patent
Wolfe et al.

(10) Patent No.: US 7,910,529 B2
(45) Date of Patent: Mar. 22, 2011

(54) FUNCTIONAL FLUID COMPOSITIONS

(75) Inventors: Terry Calvin Wolfe, Olivette, MO (US); Patrick P. B. Notté, Wavre (BE)

(73) Assignee: Solutia, Inc., St. Louis, MO (US)

( * ) Notice: Subject to any disclaimer, the term of this patent is extended or adjusted under 35 U.S.C. 154(b) by 103 days.

(21) Appl. No.: 10/980,467

(22) Filed: Nov. 3, 2004

(65) Prior Publication Data

US 2006/0094606 A1 May 4, 2006

(51) Int. Cl.
*C10M 137/10* (2006.01)
*C09K 5/00* (2006.01)

(52) U.S. Cl. ..... 508/433; 252/78.5

(58) Field of Classification Search ..... 508/433; 252/78.5, 73, 1, 399
See application file for complete search history.

(56) References Cited

U.S. PATENT DOCUMENTS

| | | | | |
|---|---|---|---|---|
| 3,405,067 | A * | 10/1968 | Fay | 252/75 |
| 3,723,320 | A | 3/1973 | Herber et al. | |
| 3,862,048 | A * | 1/1975 | Sheratte | 252/78.5 |
| 3,933,669 | A * | 1/1976 | Fowlkes | 252/78.5 |
| 3,941,708 | A | 3/1976 | Gentif et al. | |
| 4,076,642 | A * | 2/1978 | Herber et al. | 252/78.5 |
| RE37,101 | E * | 3/2001 | Deetman | 252/78.5 |
| 6,254,799 | B1 * | 7/2001 | Antika et al. | 252/78.5 |
| 2003/0047709 | A1 * | 3/2003 | Poirier | 252/78.5 |

FOREIGN PATENT DOCUMENTS

| | | |
|---|---|---|
| WO | 00/24848 | 5/2000 |

* cited by examiner

*Primary Examiner* — Anhtuan T Nguyen
*Assistant Examiner* — Amy Lang
(74) *Attorney, Agent, or Firm* — Husch Blackwell LLP

(57) ABSTRACT

There is disclosed herein novel functional fluids useful as aircraft hydraulic fluids comprising at least about 50% trialkyl phosphate ester and at least one aryl compound whereby the fluid exhibits in combination the fire resistant properties as indicated by a fire point in excess of 177° C., a flash point of at least 160° C. and an autoignition temperature of at least 400° C. The trialkyl phosphate esters contain between 6 and 18 carbon atoms and preferably between 12 and 15 carbon atoms. The aryl compounds are most preferably polyphenyls, fused ring aryl compound containing from 5 to 24 carbon atoms in the aryl portion such as biphenyl or terphenyl or alkyl substituted polyphenyls wherein the alkyl groups contain from 1 to 5 carbon atom. Other aryl compounds includes fused ring aryl compounds such as naphthalene, anthracene, diphenyl oxide and the like.

16 Claims, No Drawings

FUNCTIONAL FLUID COMPOSITIONS

BACKGROUND OF INVENTION

This invention relates to phosphate ester functional fluid compositions and more particularly to compositions containing alkyl phosphate esters and non phosphate aryl compounds useful as aircraft hydraulic fluids.

Functional fluids have been utilized as electronic coolants, diffusion pump fluids, lubricants, damping fluids, bases for greases, power transmission and hydraulic fluids, heat transfer fluids, heat pump fluids, refrigeration equipment fluids, and as a filter media for air-conditioning systems. Hydraulic fluids intended for use in the hydraulic system of aircraft for operating various mechanisms and aircraft control systems must meet stringent functional and use requirements. Among the most important requirements of an aircraft hydraulic fluid is that it be stable against oxidative and hydrolytic degradation at elevated temperatures. Furthermore, such aircraft hydraulic fluids must also maintain low temperature pour point as well as high autoignition temperature, high flash and fire points and acceptable viscosity at a wide range of temperatures Most aircraft hydraulic fluids used in civilian aircraft contain some combination of phosphate esters including trialkyl phosphates, dialkyl aryl phosphate esters, alkyl diaryl phosphate esters and tri aryl phosphate esters. A hydraulic fluid useful in aircraft is available from applicants' assignee under the trademark Skydrol.®. LD4. This composition typically contains 18 to 25% by weight dibutyl phenyl phosphate, 50 to 60% by weight tributyl phosphate, 4 to 8% of butyl diphenyl phosphate, 5 to 10% of viscosity index improvers, 0.13 to 1% of a diphenyldithioethane copper corrosion inhibitor, 0.005% to about 1% by weight, but preferably 0.0075% to 0.075% of a perfluoroalkylsulfonic acid salt antierosion agent, 4 to 8% by weight of an acid scavenger of the type described in U.S. Pat. No. 3,723,320 and about 1% by weight of 2,6-di-tertiary-butyl-p-cresol as an antioxidant. This composition has proved highly satisfactory in high performance aircraft application.

Commercially successful aircraft hydraulic fluids now in service contain some amount of aryl phosphate esters. However, such fluids must meet new requirements. These requirements include improved fluid life, improved fire resistance and minimum low temperature viscosity. While investigating fluids to meet the new requirements it has been discovered that aryl phosphate esters are not required and, in fact, certain non-phosphate aryl components actually provide improved thermal stability and lower low temperature viscosity.

SUMMARY OF INVENTION

In accordance with this invention there is provided novel functional fluids suitable for use as an aircraft hydraulic fluid. Such fluids comprise at least one trialkyl phosphate ester and at least one aryl compound wherein the triakyl phosphate comprises at least about 50%, by weight of the total composition.

Typically, the functional fluids of this invention comprise a fire resistant trialkyl phosphate ester base stock in the range of from about 50% to about 75% and an aryl compound in the range of from about 5% to about 20%. Preferably, the composition of this invention comprises from about 55% to about 70% trialkyl phosphate ester and from about 10% to about 15% of an aryl compound. More particularly, typical compositions of this invention comprise from about 60% to about 65% of a trialkyl phosphate ester and from about 10% to about 12% of an aryl compound. A typical composition of this invention is one containing about 60% tributyl phosphate ester, about 10% triisobutyl phosphate ester and 10% isopropylated naphthalene.

Of course, compositions of this invention employed as aircraft hydraulic fluids will also contain from about 10% to about 20% of additives to provide various functions such as viscosity index improvement, acid scavengers, anti-erosions agents, corrosion inhibitors of various types, anti-foaming agents and anti-oxidants as will be more particularly pointed out below.

DETAILED DESCRIPTION OF THE INVENTION

The base stock of the fuictional fluids of this invention comprise at least one trialkyl phosphate ester having the formula

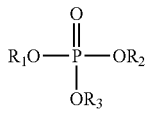

wherein $R_1$, $R_2$ and $R_3$ are alkyl groups having from 1 to 14 carbon atoms wherein the sum of carbon atoms in $R_1$, $R_2$ and $R_3$ is in the range of from 9 to 18 and preferably in the range of from about 12 to about 15 carbon atoms. The alkyl groups may be the same or different in the phosphate ester. It has been found that the above carbon atom range provides phosphate esters that, when combined with art recognized additives and aryl compounds of this invention, provide the essential properties suitable for use in aircraft hydraulic systems. Such essential properties are a fire point of at least 177° C., a flash point of at least 160° C., an autoignition temperature of at least 399° C., a pour point of less than −62° C., a viscosity at −54° C. less than 2000 cS and a viscosity at 98.9° C. greater than 3.0 cS.

Typical suitable alkyl groups of the phosphate esters of this invention include methyl, ethyl, propyl, isopropyl, butyl, isobutyl, tertiary butyl, pentyl, isopentyl, neopentyl, hexyl, heptyl, octyl, decyl, undecyl, dodecyl and mixtures and isomers thereof. Preferably, the alkyl groups of the phosphate ester are $C_4$ and $C_5$ It is further preferred that the alkyl groups of the above noted phosphate esters are isoalkyl groups.

Another important component of the functional fluids of this invention is at least one aryl compound, substituted aryl compound, fused ring aryl compound, substituted fused ring aryl compound, hydrogenated aryl compound and mixtures thereof. Typical aryl compounds are selected from monocyclic compounds, polyphenyls, fused ring aryl compounds containing from 5 to 24 carbon atoms in the aryl portion. To provide the properties required as noted herein some substituted aryl compounds are employed. Such substituted aryl compound, such aryl compounds include for example, diphenyl oxide, alkylated phenyls may have a total number of carbon atoms in the range of from about 10 to about 40 carbon atoms in total. Typical aryl compounds include biphenyls, terphenyls, furans, thiophenes, benzenes, benzofurans, indanes, pyridines, quaterphenyls, and partially hydrogenated polyphenyls, such as partially hydrogenated terphenyl. Typical aryl compounds useful in compositions of this invention include benzylated toluene/xylene mix commercially available as Marlotherm S from Huls, ethylated biphenyl, available from Nippon Steel as Therm. S 600, alkylated diphenyl oxide, $C_{14}$ to $C_{30}$ alkyl aryl compound commercially available from Solutia, Inc. as Therminol 55, mixed ethyl phenyls available commercially from Solutia Inc. as Therminol 59, dialkyl benzene available commercially from Solutia Inc. as Therminol ALD, and Diphyl DT, a ditolyl ether commercially available from Bayer AG,.

Typical examples of ring aryl compounds include naphthalene and anthracene. A typical ring aryl compound is styrenated tetralin, available commercially from Dow Chemical Co. as Dowtherm RP.

The term "substituted aryl compounds" as employed herein means compounds including alkyl substituted aryl compounds wherein the alkyl substituent contains from 1 to about 30 carbon atoms and derivatives thereof: other substituents included in the term "substituted aryl compounds" include methyl, ethyl, propyl, isopropyl, butyl, isobutyl, tert. butyl, pentyl, isopentyl and mixtures thereof, alkoxy and aryloxy groups and mixtures thereof, cycloalkyl substituents such as cyclopentyl, cyclohexyl and mixtures thereof. Such aryl compounds include, for example, methyl biphenyl, dimethyl biphenyl, dimethyl terphenyl, diisopropyl biphenyl, isopropyl biphenyl, isopropyl terphenyl, isopropyl naphthalene, and diisopropyl naphthalene.

All percentages provided in the description and claims herein are percent by weight unless otherwise noted.

As noted above the functional fluids of this invention contain many additives as is well known in the art to provide various beneficial properties to the fluid or aid in preventing degradation or the effects of degradation during use. Such additives are described in RE 37,101 E, to Deetman, which is incorporated herein by reference.

The following examples illustrate the invention.

added. After thorough mixing of these ingredients, other additives were added in the sequence indicated in Table 1. The compositions were then tested to determine their properties with regard to autoignition temperature (AIT), flash point (flash), fire point (Fire), viscosity, pour point and specific gravity. In Table 1, all examples are based upon 100 gram samples.

In Table 1, "TBP" and "TIBP" refer to tributyl phosphate ester and triisobutyl phosphate ester, respectively. "Van Lube" refers to a commercial rust inhibitor, available from Vanderbilt as Van Lub RIG. "FC-98" refers to an antierosion agent comprising a potassium salt of perfluorooctylsulfonic acid, also known as perfluorooctanesulfonic acid. "Ionol" refers to 2,6-di-tert-butyl-p-cresol, an antioxidant, commercially available from Shell Chemical Company. "E-330" refers to 1,3,5-trimethyl-2,4,6-tris(3,5-di-tert-butyl hydroxyphenyl)benzene, an antioxidant, commercially available under the trade designation Ethanox.®. 330 from Ethyl Corporation. "DODPA" refers to dioctyl diphenyl amine available from Vanderbilt, "FH-132" refers to 1,2-di(phenylthio) ethane, a copper corrosion inhibitor, "MCS-1562" refers to 2-ethylhexyl epoxy cyclohexyl carboxylate, available from Dixie Chemicals, "Ruetasolv DI" is di-isopropyl naphthalene, "Ruetasolv BP-4201" is di-isopropyl biphenyl and KMC 500 is isopropyl biphenyl, which are commercially available from Rutgers Kureha, "Therminol 66" is a heat transfer fluid comprising a partially hydrogenated terphenyl available from Solutia Inc., "HF411" and "HF460" refer to poly(butyl/hexyl methacrylate) viscosity index improvers, "Antifoam" refers to 2,6-Di-tert-butyl-p-cresol available from Dow Corning Co.

TABLE I

| Ingredients | Sample I | Sample II | Sample III | Sample IV | Sample V | Sample VI | Sample VII |
|---|---|---|---|---|---|---|---|
| TBP | 70.3285 | 60.4285 | 60.4285 | 62.4285 | 62.4285 | 71.1885 | 61.1285 |
| TIBP | | 10 | 10 | 10 | 10 | | 10 |
| Van Lube | 0.025 | 0.025 | 0.025 | 0.025 | 0.025 | 0.025 | 0.025 |
| FC-98 | 0.025 | 0.025 | 0.025 | 0.025 | 0.025 | 0.025 | 0.025 |
| IONOL | 0.7 | 0.7 | 0.7 | 0.7 | 0.7 | 0.7 | 0.7 |
| E330 | 0.45 | 0.45 | 0.45 | 0.45 | 0.45 | 0.45 | 0.45 |
| DODPA | 0.45 | 0.45 | 0.45 | 0.45 | 0.45 | 0.45 | 0.45 |
| FH-132 | 0.5 | 0.5 | 0.5 | 0.5 | 0.5 | 0.5 | 0.5 |
| Dye | 0.001 | 0.001 | 0.001 | 0.001 | 0.001 | 0.001 | 0.001 |
| MCS-1562 | 6 | 6 | 6 | 6 | 6 | 6 | 6 |
| Ruetasolv DI | 10 | 10 | 10 | | | | |
| Ruetasolv BP-4201 | | | | 10 | | | |
| Therminol 66 | | | | | 10 | 10 | 10 |
| HF411 (35.5% solids) | 6.4 | 6.34 | 6.34 | 6.34 | 6.34 | 5.92 | 5.96 |
| HF 460 (58% solids) | 5.12 | 5.08 | 5.08 | 5.08 | 5.08 | 4.74 | 4.76 |
| Antifoam | 0.0005 | 0.0005 | 0.0005 | 0.0005 | 0.0005 | 0.0005 | 0.0005 |

EXAMPLE 1

Hydraulic fluids having compositions set forth in Table 1 were prepared by mixing at ambient temperature in a suitable container agitated to provide adequate mixing. The phosphate ester components were introduced into the tank first and, after a 30-minute period of initial mixing, the aryl compound was Tests were conducted to determine the fire safety, low temperature viscosity and specific gravity of the fluids described in Table 1. The results of these tests appear in Table 2 below. In Table 2 "AIT" refers to the autoignition temperature of the sample. Also, "4-ball @ 40 kg" refers to a 4-ball wear test of fluid lubricity. The results of the tests appear below in Table 2.

TABLE 2

| TEST | Sample I | Sample II | Sample III | Sample IV | Sample V | Sample VI | Sample VII |
|---|---|---|---|---|---|---|---|
| AIT ° C. | 412 | 422 | 424 | 418 | 405 | 408 | 408 |
| Flash Point ° C. | 164 | 164 | 174 | 181 | 166 | 164 | 173 |
| Fire Point ° C. | 189 | 188 | 189 | 195 | 194 | 193 | 196 |
| Viscosity @ −54° C. | 809 | 921 | 930 | 1009 | 903 | 895 | 1067 |
| Viscosity @ 37.7° C. | 8.79 | 8.88 | 8.91 | 9.25 | 8.85 | 8.97 | 9.17 |
| Viscosity @ 98.9° C. | 3.16 | 3.15 | 3.15 | 3.22 | 3.17 | 3.15 | 3.21 |
| Pour Pt. @ −62.2° C. | Pass | Pass | Pass | Pass | Pass | Pass | Pass |
| Spec. Gr. | 0.979 | 0.978 | 0.978 | 0.978 | 0.98 | 0.985 | 0.983 |
| 4-ball @ 40 kg | 0.6 | 0.67 | | | | 0.63 | 0.65 |

To compare the above test results of the novel fluids of this invention with typical prior art fluids several fluids of the prior art were prepared and tested. As in Table 1 above, the samples are based upon 100 g. In Table 3, S-154 refers to Santicizer 154 available from Ferro Corp. that is tert-butylphenyl diphenyl phosphate ester. A prior art composition (Sample VIII) is described in Table 3 below together with samples containing both a aryl phosphate ester and aryl compounds of this invention (Samples IX and X).

TABLE 3

| Ingredients | Sample VIII | Sample IX | Sample X |
|---|---|---|---|
| TBP | 62.4885 | 52.5285 | 54.0785 |
| TIBP | 10 | 10 | 10 |
| Van Lube | 0.025 | 0.025 | 0.025 |
| FC-98 | 0.025 | 0.025 | 0.025 |
| IONOL | 0.7 | 0.7 | 0.7 |
| E330 | 0.45 | 0.45 | 0.45 |
| DODPA | 0.45 | 0.45 | 0.45 |
| FH-132 | 0.5 | 0.5 | 0.5 |
| Dye | 0.001 | 0.001 | 0.001 |
| MCS-1562 | 6 | 6 | 6 |
| S-154 | 9 | 9 | 9 |
| Ruetasolv DI | | 10 | |
| Ruetasolv BP-4201 | | | |
| KMC 500 | | | |
| Therminol 66 | | | 10 |
| HF411 (35.5% solids) | 5.76 | 5.72 | 4.87 |
| HF 460 (58% solids) | 4.6 | 4.6 | 3.9 |
| Antifoam | 0.0005 | 0.0005 | 0.0005 |

The compositions described in Table 3 above were tested similarly to those compositions described in Table 1 and reported in Table 2. The results of those tests of the prior art fluids are presented in Table 4 below.

TABLE 4

| TEST | Sample VIII | Sample IX | Sample X |
|---|---|---|---|
| AIT ° C. | 409 | 420 | 409 |
| Flash Point ° C. | 176 | 183 | 176 |
| Fire Point° C. | 189 | 194 | 194 |
| Viscosity @ −54° C. | 904 | 1679 | 1826 |
| Viscosity @ 37.7° C. | 8.78 | 9.83 | 9.45 |
| Viscosity @ °98.9° C. | 3.09 | 3.28 | 3.11 |
| Pour Pt. @ −62.2° C. | Pass | Pass | pass |
| Spec.Gr. | 0.995 | 0.995 | 1 |
| 4-ball @40kg | 0.64 | 0.68 | 0.65 |

The data in Table 4 above illustrate the surprising results obtained by this invention. A comparison of low temperature viscosity indicates that by simply adding the aryl compounds of this invention to a commercial fluid the low temperature viscosity is greatly and adversely affected. The above data show that not only is it possible to remove the aryl phosphate ester from the commercial fluid but that improved properties are obtained by replacing the aryl phosphate ester of the prior art with alkyl aryl compounds of this invention. However, as indicated by the data in Table 2, particularly as shown by Sample I, the composition of this invention exhibits favorable low temperature viscosity as compared to the conventional fluid illustrated by Sample VIII.

While this invention has been described with respect to various specific examples and embodiments, it is to be understood that the invention is not limited thereto. Specifically, the compositions of this invention comprise a trialkyl phosphate ester base stock and an aryl compound selected from substituted aryl compounds, fused ring aryl compounds, substituted fused ring aryl compounds, hydrogenated aryl compounds, and mixtures thereof. As with functional fluids of the prior art, many other ingredients can be incorporated within the compositions of this invention, including, for example, other base stocks and other additive materials. The incorporation of such other ingredients may materially affect some properties of the resulting composition, as for example viscosity, lubricity, foamability, flammability and the like but in no way diminish the utility of the instant invention. It is apparent therefore that the compositions of the instant invention are not to be limited to the essential ingredients as defined herein, but may be used in combinations and mixtures with numerous other compositions as would be readily apparent to those skilled in the art.

The invention claimed is:

1. A composition useful as a fire resistant commercial aviation hydraulic fluid composition comprising (A) at least about 50% by weight of a phosphate ester or mixture of phosphate esters represented by the formula

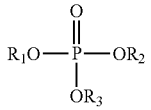

wherein $R_1$, $R_2$ and $R_3$ are alkyl groups having from 1 to 14 carbon atoms wherein the sum of carbon atoms in $R_1$, $R_2$ and $R_3$ is in the range of from 9 to 18, and (B) at least about 10% of at least one substituted or unsubstituted, non-phosphate aryl compound, said aryl compound selected from the group consisting of phenyls, biphenyls, terphenyls, furans, thiophenes, benzenes, benzofurans, indanes, pyridines, benzylated toluene/xylene mixture, diphenyl oxides, naphthalene and anthracene and mixtures thereof wherein the substituents on the substituted aryl compounds are selected from the group consisting of alkyl groups having from 1 to about 30 carbon atoms, cycloalkyl, alkoxy and aryloxy groups and mixtures thereof, and wherein said composition exhibits, in combination, a fire point in excess of 177° C., a flash point of at least 160° C. and an autoignition temperature of at least 399° C., a pour point less than −62° C., a viscosity at −54° C. less than 2000 cS, and a viscosity at 98.9° C. greater than 3.0 cS.

2. A composition of claim 1 wherein the amount of phosphate ester is in the range of from about 50% to about 75% and the amount of aryl compound (B) is in the range of from about 10% to about 20%.

3. A composition of claim 1 wherein the amount of phosphate ester is in the range of from about 55% to about 70% and the aryl compound (B) is in the range of from about 10% to about 15%.

4. The composition of claim 1 wherein the amount of phosphate ester is in the range of from about 60% to about 65% and the amount of aryl compound (B) is in the range of from about 10% to about 12%.

5. The composition of claim 1 wherein (A) is a mixture of different phosphate esters.

6. The composition of claim 5 wherein the phosphate ester mixture comprises two different trialkyl esters.

7. The composition of claim 6 wherein the mixture comprises about 60% tributyl phosphate ester and about 10% triisobutyl phosphate ester.

8. The composition of claim 7 wherein (B) is a substituted non-phosphate aryl compound wherein the substituents are alkyl radicals selected from the group consisting of methyl, ethyl, propyl, isopropyl, butyl, isobutyl, tertiary butyl, pentyl, isopentyl and neopentyl.

9. The composition of claim 8 wherein the aryl compound (B) is isopropylated naphthalene.

10. The composition of claim 1 wherein the aryl compound (B) is selected from the group consisting of substituted and unsubstituted diphenyl oxide and alkylated phenyls.

11. The composition of claim 1 wherein the aryl compound is selected from the group consisting of biphenyl and terphenyl.

12. The composition of claim 10 wherein the fused ring aryl compound is selected from the group consisting of naphthalene and anthracene.

13. A composition comprising about 70% tributyl phosphate ester and about 10% isopropylated naphthalene.

14. A composition comprising about 70% tributyl phosphate ester and about 10% isopropylated naphthalene and about 20% additives.

15. A composition comprising about 60% tributyl phosphate ester, about 10% triisobutyl phosphate ester, about 10% isopropylated naphthalene and about 20% additives.

16. A composition comprising about 62% tributyl phosphate ester, about 10% triisobutyl phosphate ester, about 10% diisopropyl biphenyl and about 18% additives.

* * * * *